US010398204B1

(12) United States Patent
Morgan

(10) Patent No.: US 10,398,204 B1
(45) Date of Patent: Sep. 3, 2019

(54) PROTECTIVE COVERING FOR ELECTRONIC DEVICES

(71) Applicant: Glen Davis Morgan, Marina Del Rey, CA (US)

(72) Inventor: Glen Davis Morgan, Marina Del Rey, CA (US)

( * ) Notice: Subject to any disclaimer, the term of this patent is extended or adjusted under 35 U.S.C. 154(b) by 281 days.

(21) Appl. No.: 15/337,628

(22) Filed: Oct. 28, 2016

Related U.S. Application Data

(60) Provisional application No. 62/247,531, filed on Oct. 28, 2015.

(51) Int. Cl.
*A45C 11/00* (2006.01)
*A45C 13/00* (2006.01)
*A45F 5/00* (2006.01)

(52) U.S. Cl.
CPC ..... *A45C 11/00* (2013.01); *A45C 13/002* (2013.01); *A45F 5/00* (2013.01); *A45C 2011/002* (2013.01); *A45C 2011/003* (2013.01)

(58) Field of Classification Search
CPC . A45C 11/00; A45C 13/002; A45C 2011/002; A45C 2011/003; A45F 5/00
See application file for complete search history.

(56) References Cited

U.S. PATENT DOCUMENTS 9,031,623 B2 5/2015 Yoo
2016/0106189 A1* 4/2016 Takayama ..... A45C 11/00 224/191

OTHER PUBLICATIONS

Snijlab, "Folding Wood Booklet," Oct. 19, 2011, https://www.thingiverse.com/thing:12707 , Summary and Pictures (Year: 2011).*
Studio eQ, "iPhone Wrap Install," Aug. 18, 2014, https://www.youtube.com/watch?v=X5hUT-SljSs (Year: 2014).*

* cited by examiner

*Primary Examiner* — Corey N Skurdal
(74) *Attorney, Agent, or Firm* — Advantage IP Law Firm

(57) ABSTRACT

A protective covering for an electronic device with a case defining a viewscreen and a pre-determined feature pattern with at least one feature provided by a protective covering body having foldable sections defining a viewing window and a set of one or more feature apertures and constructed to fold about the case of the electronic device to substantially align the viewing window with the viewscreen and align at least one aperture with at least one feature to provide access thereto.

17 Claims, 15 Drawing Sheets

PROTECTIVE COVERING FOR ELECTRONIC DEVICES

CROSS-REFERENCE TO OTHER APPLICATIONS

This application claims the benefit of U.S. Application No. 62/247,531, filed on Oct. 28, 2015, entitled the same, and which is hereby incorporated by reference in its entirety.

BACKGROUND OF THE INVENTION

1. Field of the Invention

The present invention relates generally to protective coverings for electronic devices. More specifically, the present invention relates to protective coverings, especially those constructed from a single piece of material, for use in protecting consumer electronics such as mobile devices.

2. Background Art

Mobile devices such as smartphones, smart watches, cellular phones, tablets, laptops, and other portable electronic devices are ubiquitous in today's world. While the sizes and functions, and features vary somewhat, most of these devices protect expensive electronics within a rigid plastic outer casing with an opening for a user interface screen visible through a plastic or glass lens. Daily use of these devices commonly results in frequent impacts to the casing leading to cracking, chipping, or breaking the outer casing. This typically leaves the outer casing with an undesirable appearance. In addition, such mobile devices are often expensive to replace. Given such concerns, most owners prefer protecting their mobile devices over and above the factory protective casing. Two general types of protection commonly exist.

One example of protecting a mobile device such as a smartphone involves a two-piece casing with a front piece and a rear piece. In use, the mobile device is typically placed on top of the rear piece and the front piece is then snapped onto the rear piece to encase the mobile device. The front piece commonly includes an opening for viewing the user interface of the mobile device. Both pieces may have apertures or form apertures at their joints to provide access to any buttons on the mobile device as well.

Another common approach is a two-piece casing having a top half and a bottom half. The mobile device typically slidably engages the bottom half of the two-piece casing and then the top half is slid into place until it locks with the bottom half, again forming a protective casing.

While these two piece casings serve a purpose in protecting the mobile device, they also tend to grow brittle over time and each separation significantly increases the likelihood of any retaining tab or tooth breaking thus rendering the two-piece casing useless as the two casing pieces will not hold together. The user often results to using unsightly tape to hold the casings together, gluing the broken parts in an attempt to repair the broken part, or discarding the case and purchasing a new one to take a chance the new casing won't break as well during use.

Another protective casing alternative is the rubberized skin. For these products, the skin is formed of a flexible rubberized material and is simply slipped over the mobile device to provide some additional protection. The skin includes apertures for viewing the mobile device screen and accessing buttons and ports. Another approach is the use of rubberized overmolds or overlay on the edges of the mobile device casing to provide some additional protection as well. The skin and overmold approaches also serve a purpose, including an improved gripping surface over the rigid plastic casings.

Another protective casing may be provided in the form of a case constructed of leather or fabric material wherein the electronic device is slipped into a pocket with a viewing window coinciding with the viewscreen of the electronic device. The separate pocket piece is typically sewn into one side of a backing with a second portion of the backing constructed to fold over, onto the pocket concealing the entire electronic device and its functions and features within the folded backing. In use, the folded portion must be unfolded to reveal the viewscreen of the electronic device and access the functions and features.

While the two-piece rigid plastic casings, the rubberized skin casings, and the leather folding cases have their advantages, these other protective coverings typically add a significant added expense for preparing molds or patterns for a variety of mobile devices. In addition, those other protective covering constructed of more than one piece of material introducing additional assembly steps and joint and seam weaknesses where the parts are assembled together.

Therefore, what is needed is and heretofore unavailable is an improved, economical, protective covering or casing that reduces the costs associated with creating a variety of molds to accommodate a variety of mobile devices and that may incorporate both functional and decorative features.

SUMMARY OF THE INVENTION

In accordance with the principles of the present invention, a protective covering for electronic devices with a case defining a viewscreen and a pre-determined feature pattern with at least one feature may be provided by a protective covering body having foldable sections defining a viewing window and a set of one or more feature apertures and constructed to fold about the case of the electronic device to substantially align the viewing window with the viewscreen and align at least one aperture with at least one feature to provide access thereto.

In another embodiment, the protective covering body may incorporate a storage knockout with one or more apertures for releasably retaining complementary knockouts removed from the protective covering body.

In yet another embodiment, the protective covering body includes a primary section and two adjacent folding sections joined to the primary section by a corresponding wall having outwardly extending sidewall protectors with the entire protective covering body being constructed to fold about and protect all six faces of the electronic device while still providing access to the viewscreen and features of the electronic device.

Another feature of the present invention is the use of unitary piece of material to form the protective covering.

In yet another embodiment, the unitary piece of material either wood, grass, or another plant-based material.

Other aspects of the present invention include the ability of the protective covering to fold together and be releasably retained in a folded configuration by attaching to the electronic device or two opposing sections of the protective covering body.

Methods of forming a protective covering for electronic devices are also disclosed herein.

All of the embodiments summarized above are intended to be within the scope of the invention herein disclosed.

However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

Figure 1:
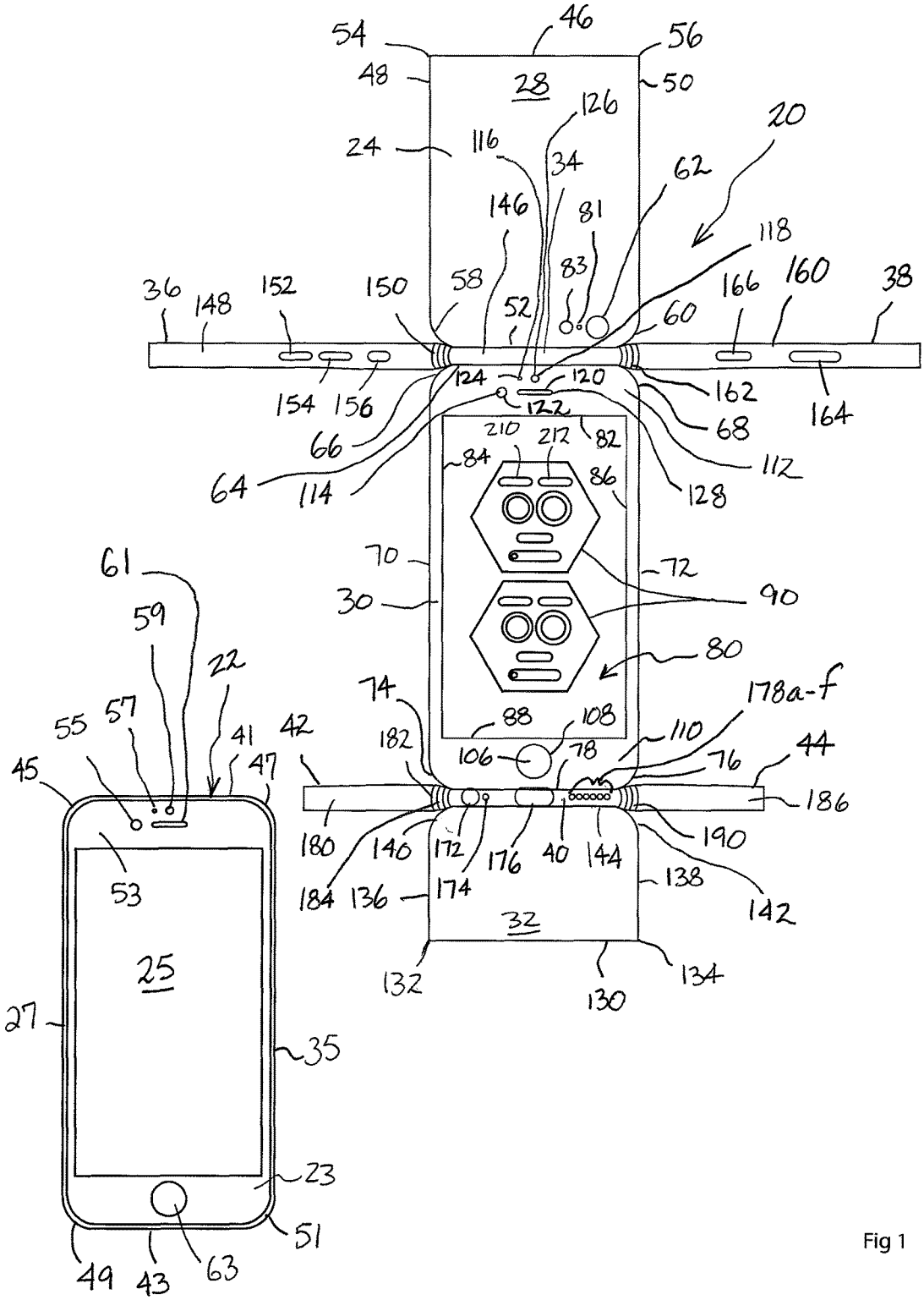
FIG. 1 is an exterior view of an exemplary protective covering in an unfolded configuration as constructed in accordance with the principles of the present invention and the front side view of an exemplary mobile device placed adjacent to the protective covering.
Figure 2:
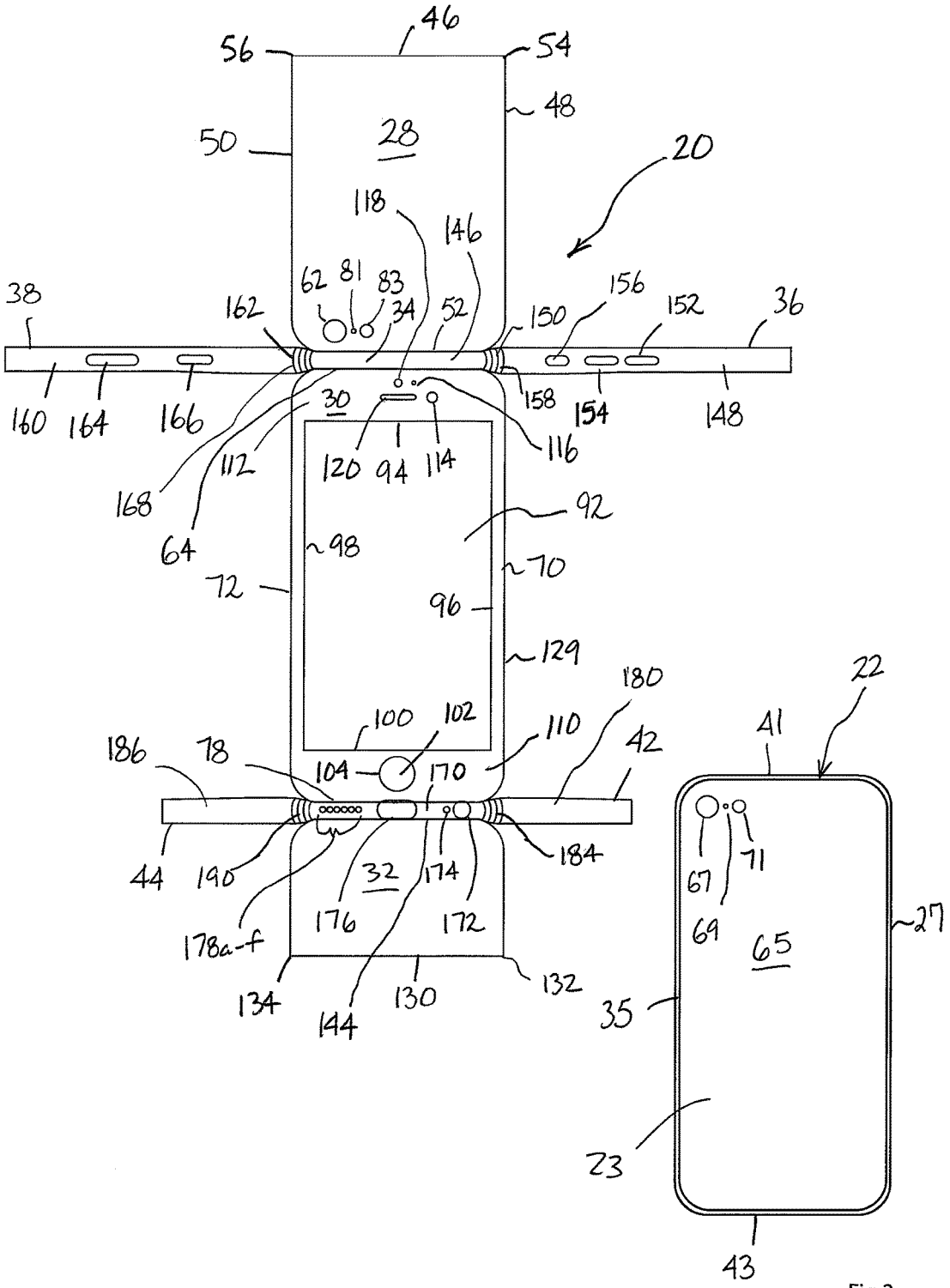
FIG. 2 is an interior view of the unfolded protective covering of FIG. 1 with ah exemplary screen knockout removed and a rear side view of the mobile device of FIG. 1 placed adjacent to the protective covering.
Figure 12:
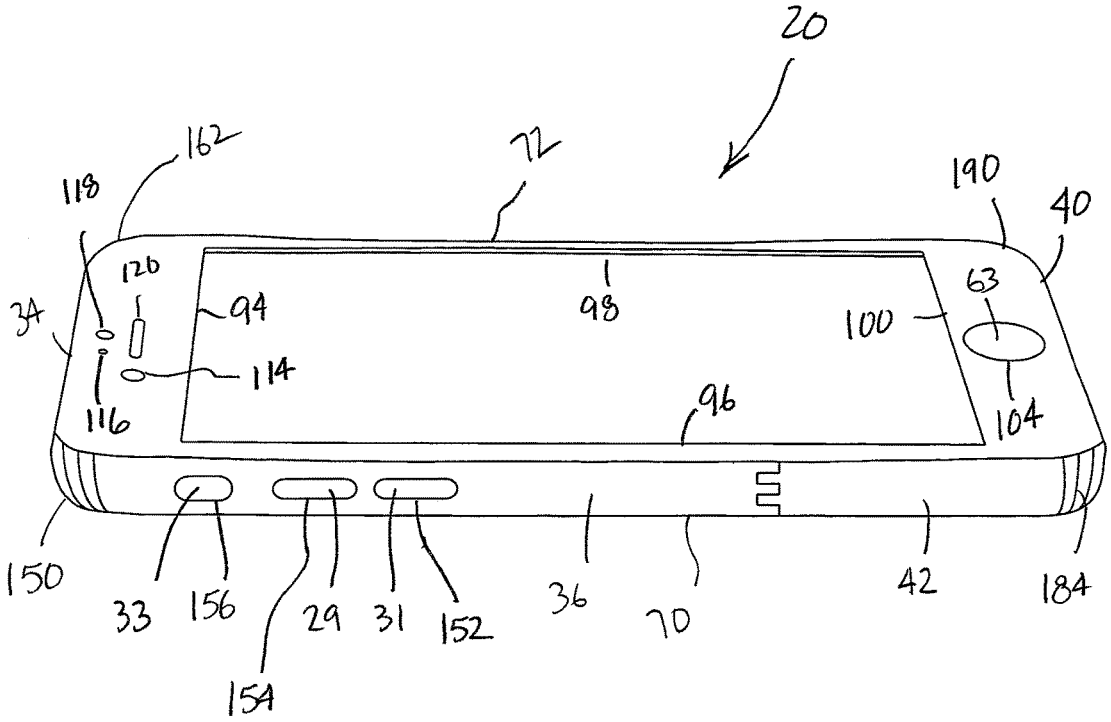
FIG. 12 is a left side perspective view of the encased mobile device of FIG. 9.

Referring now to FIGS. 1-2 and 12, a protective covering, generally designated 20, is provided for encasing and protecting a mobile device, generally designated 22. In this exemplary embodiment, the mobile device is a conventional iPhone 5, 5S, 6, or 6S. The mobile device includes its own six-sided casing 23, including a front face framing a user interface viewscreen 25, a left edge or left face 27 with a set of up and down volume buttons, 29, 31, respectively, and a mute switch 33, also called a ring/silent button (FIG. 12). The mobile device 22 further includes a right edge or right face 35 with an on/off hold switch 37 and a lower SIM card slot 39. The mobile device has a top edge or top face 41 and a bottom edge or bottom face 43 and an upper left rounded corner 45, upper right rounded corner 47, lower left rounded corner 49, and a lower right rounded corner 51. Just below the top edge 41 of the mobile device on the front side 53 are a front camera 55, a microphone 57, a flash 59, and a speaker 61. Just above the bottom edge 43 of the mobile device 22 is a home button 63.

Still referring to FIG. 2, the rear surface or rear face 65 of the mobile device 22 also includes a rear camera 67, a rear microphone, 69, and a rear flash 71. The top edge of the mobile device 22 is relatively unadorned. As shown in FIGS. 7, and 9-11, the bottom edge 43 of the mobile device, however, includes an audio headphone jack 73, a microphone 75, a power/data port 77 (also known as a lightning port), and a speaker 79. The set of features and/or functions such as, but not limited to, the camera, microphone, flash, jacks, data ports, speakers, switches, slides, dials, touch interface, and buttons appearing on the collection of the six faces of an electronic device 22 define a feature or functional pattern or arrangement for that device as defined by their location and spacing about the electronic device that may be used when preparing the protective covering as discussed below. These features and/or functions may be interactive or not interactive.

The protective covering 20 is constructed to closely conform to and substantially mimic the case of the mobile device 22 while providing access to the functional features of the mobile device described above. More specifically, as shown in FIGS. 1-2, the protective covering 20 has an exterior surface 24 (FIG. 1) and an interior surface 26 (FIG. 2). Moreover, the protective covering may be broken down into several discrete sections. In this exemplary embodiment, the unfolded protective covering 20 of FIGS. 1-2 includes a top section or panel 28, a central section 30, and a bottom, section 32. Positioned between the top and central sections 28 and 30, respectively, is a top wall 34 that extends outwardly in opposing directions into an upper left sidewall (wing) 36 and an upper right sidewall (wing) 38. Positioned between the central and bottom sections 30 and 32, respectively, is a bottom wall 40 that extends outwardly in opposing directions into a lower left sidewall (wing) 42 and a lower right sidewall (wing) 44.

With continued reference to FIG. 1, the top section 28 is generally planar and includes a top edge 46 and parallel opposing left and right edges 48, 50, respectively, that meet the top edge at right angles. Opposing the top edge 46 is a first fold line 52 that demarcates the transition from the top section 28 to the top wall 34. It will be appreciated that the fold lines incorporated into the protective covering 20 provide a hinged coupling or joint between adjacent components, sections, or walls allowing for adjacent components to be folded over onto one another and about the electronic device. While left and right edges 48, 50, respectively, meet the top edge 46 at right angles to form square left and right corners 54, 56, respectively, the left and right edges 48, 50 of the top section curve inwardly to meet the first fold line to form left and right rounded shoulders 58, 60, respectively. Within the top section is a camera cutout 62 for aligning or registering with the rear camera 67 (FIG. 2) of the mobile device 22. In addition to the camera cutout 62, there is also a rear microphone knockout 81 and a rear flash knockout 83.

With continued reference to FIG. 1, the central section 30 includes a second fold line 64 where the central section meets the top wall 34. The second fold line curves on opposing sides to form left and right upper transition shoulders 66, 68 that extend in a straight line to form the left and right opposing outer edges 70, 72, respectively, of the central section 30. The outer edges continue in a straight line until transitioning to left and right lower curved transition shoulders 74, 76 that merge into a third fold line 78 that separates the central section 30 from the bottom wall 40.

Still referring to FIG. 1, the central section 30 includes a rectangular user interface or screen knockout, generally designated 80. The screen knockout 80 includes an upper edge 82, left side edge 84, opposing right side edge 86, and a bottom edge 88, all linear in this exemplary embodiment. These edges 82, 84, 86, and 88 include weakened score lines between the screen knockout 80 and the remainder of the central section 30 to facilitate removal of the screen knockout 80. It will be appreciated that the screen knockout 80 is constructed with dimensions to match or exceed the dimensions of the user interface 25 of the mobile device 20 and the same or similar shape as well. The exterior surface 24 of the screen knockout 80 may include a decorative indicia, advertising, or a design element 90, that may either be engraved, carved, burned, etched, screened, or imprinted into the exterior surface 24 of the screen knockout 80 when preparing the protective covering or by adhering or otherwise attaching such decorative feature onto the exterior surface 24 of the screen knockout 80. Similar decorative features may be added to the exterior surface 24 of the top and bottom sections 28 and 32, respectively, or other edges and surfaces of the protective covering 20 as well.

Figure 8:
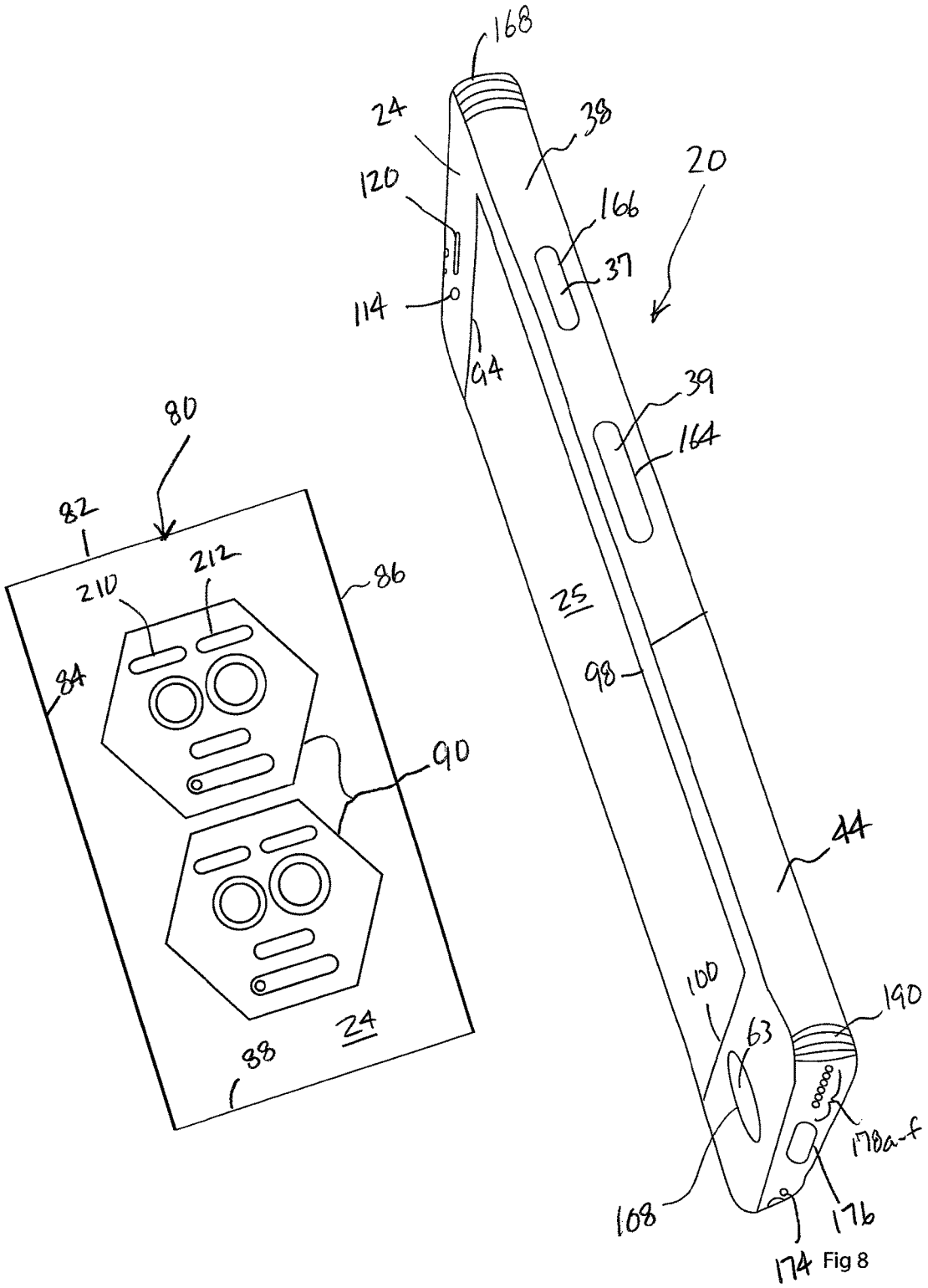
FIG. 8 is a perspective side view of the fully folded protective covering adjacent the removed screen knockout piece.

As shown in FIGS. 2 and 8, the screen knockout 80 may be removed leaving a viewing window 92 with a top edge 94, left edge 96, right edge 98, and bottom edge 100, all corresponding to the edges 82, 84, 86, 88 of the screen knockout 80. For reference purposes, left and right positioned are based on the protective covering 20 as shown in FIG. 1 and thus are reversed when shown in the flipped over protective covering of FIG. 2.

Referring now to FIGS. 1-2, 4-5, and 7-8, the central section 30 further includes a home button knockout 102 with a circular rim 104 provided by a weakened section or score line and which may be punched out to provide a home button aperture 106 with a circular periphery 108. The home button aperture 106 is generally sized to match the dimensions of the home button 63 on the mobile device 22. In this exemplary embodiment, the home button knockout 102 is spaced just below the bottom edge 88 of the screen knockout 80 and above the third fold line 78 within a reduced bottom section 110 of the central section 30.

At an opposing reduced top section 112 of the central section 30 is another set of knockouts including a front camera lens knockout 114, a front microphone knockout 116, a front flash knockout 118, and a front speaker knockout 120. The front camera lens knockout, flash knockout, and auxiliary knockout are all circular in shape while the speaker knockout is in the form of a racetrack shape. Each of these knockouts 114, 116, 118, and 120 are surrounding by score lines or weakened regions 122, 124, 126, 128, respectively, to facilitate to their removal from the main body 129 of the protective covering 20. The central section 30 is planar as well.

In general terms, it will be understood that the knockouts and punch-outs described herein are shown intact in FIG. 1 and removed in FIG. 2 to reveal their respective aperture. The main body 129 of the protective covering 20 is the part of the protective covering that is left after the knockouts/punch-outs are removed.

The bottom section 32 includes an outermost bottom edge 130 which transitions at left and right square corners 132, 134, respectively, into opposing left and right sides 136, 138. The left and right sides 136, 138 of the bottom section 32 transition into left and right rounded shoulders 140, 142, respectively, at a fourth fold line 144 that separates the bottom section 32 from the bottom wall 40. The bottom section 32 is planar as well.

With continued reference to FIG. 1, the top wall 34 is bounded between the first fold line 52 and the second fold line 64 at the top and bottom respectively as shown in FIG. 1. The top wall includes a main body 146 that extends into the left and right upper sidewalls 36, 38, respectively. In this exemplary embodiment, there are no knockouts or cutouts within the main body 146 of the top wall. However, the exterior surface may include decoration if desired. Between the left side rounded shoulders 58, 66 of the top and central sections 28, 30, respectively, the upper left sidewall 36 extends outwardly. The upper left sidewall includes a first outermost operations section 148 and an adjacent innermost form section 150. The operations section 148 includes a set of three racetrack shaped button knockouts 152, 154, 156. Each of these left side button knockouts 152, 154, 156 may be removed from the protective covering 20 to access the up and down volume buttons 29 and 31, respectively, and the mute switch 33 on the mobile device 22. The form section 150 includes a series of ribs 158 that allow for formation of a rounded shoulder to match the underlying left upper side curvature 45 (FIG. 2) of the mobile device 22. It will be appreciated that the form sections described herein may be constructed to resemble a right angle corner or other shape to closely conform to the encased mobile device 22.

Between the left side rounded shoulders 60 and 68 of the top and central sections, 28 and 30, respectively, the upper right sidewall 38 also extends outwardly. The upper right sidewall includes a first outermost operations section 160 and an adjacent innermost form section 162. The operations section 160 includes a set of two racetrack shaped button knockouts 164, 166. Each of these right side button knockouts 164, 166 may be removed from the protective covering to access on/off hold switch 37 and SIM card slot 39 on the mobile device 22. The form section 162 also includes a series of ribs 168 that allow for formation of a rounded shoulder to match the underlying right upper side curvature 47 (FIG. 1) of the mobile device 22.

With continued reference to FIGS. 1-2, the bottom wall 40 includes a main body 170 (FIG. 2) bounded between the third fold line 78 and fourth fold line 144 at the top and bottom respectively as shown in FIG. 1. The main body 170 extends to the opposing lower left and lower right sidewalls 42, 44, respectively. In this exemplary embodiment, the main body 170 of the bottom wall includes an audio jack knockout 172, a bottom microphone knockout 174, a power/data port knockout 176, and a set of six speaker knockouts 178*a-f*. Each of these knockouts 172, 174, 176, 178*a-f* are surrounded by weakened regions or score lines (also referred to as vector cut lines or cut lines) to facilitate their removal and when removed provide access to the corresponding underlying features 73, 75, 77, 79 of the mobile device 22. Between the left side rounded shoulders 74, 140 of the central and bottom sections 30, 32, respectively, the lower left sidewall 42 extends outwardly. The lower left sidewall 42 includes an outermost section 180 and an adjacent innermost form section 182. The outermost section 172 does not include any knockouts in this exemplary embodiment. Like the top left counterpart, the form section 182 of the left lower sidewall includes a series of ribs 184 that allow for formation of a rounded shoulder to match the underlying left lower side curvature 49 of the mobile device 22.

Continuing with FIG. 1, between the right side rounded shoulders 76, 142 of the central and bottom sections 30, 32, respectively, the lower right sidewall 44 extends outwardly. The lower right sidewall includes an outermost section 186 and an adjacent innermost form section 188. The outermost section 186 does not include any knockouts in this exemplary embodiment. Like the top right counterpart, the form section 188 of the right lower sidewall includes a series of ribs 190 that allow for formation of a rounded shoulder to match the underlying right lower side curvature 51 of the mobile device 22.

Method of Use of the Embodiments of the Present Invention:

Referring now to FIGS. 1-14, the user lays a selected protective covering 20 on a flat surface such as a tabletop, countertop, desk, or workbench. By depressing the screen knockout or cutout piece 80 along the top, left, right and bottom edges 82, 84, 86, and 88, respectively, the user may pop out and remove the screen knockout piece 80 from the remainder of the protective covering 20 resulting in a configuration as shown in FIG. 2. The remaining knockouts 81, 83, 102, 114, 116, 118, 120, 152, 154, 156, 164, 166, 172, 174, 176, and 178*a-f* may be removed in a similar fashion. Removing a piece with weakened or scored regions will be familiar to one of ordinary skill in the art.

Figure 3:
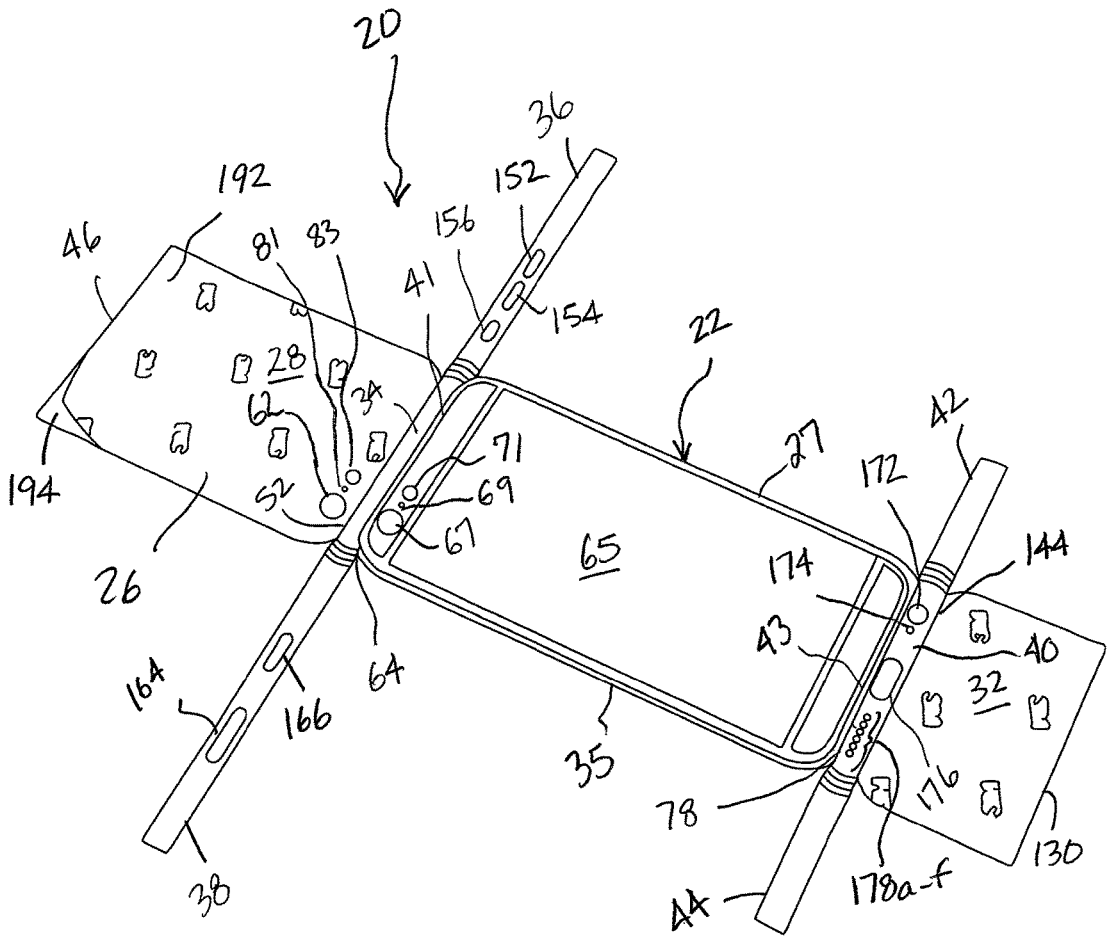
FIG. 3 is an interior view of the exemplary mobile device placed atop an unfolded protective covering as part of the folding (encasement) process.
Figure 9:
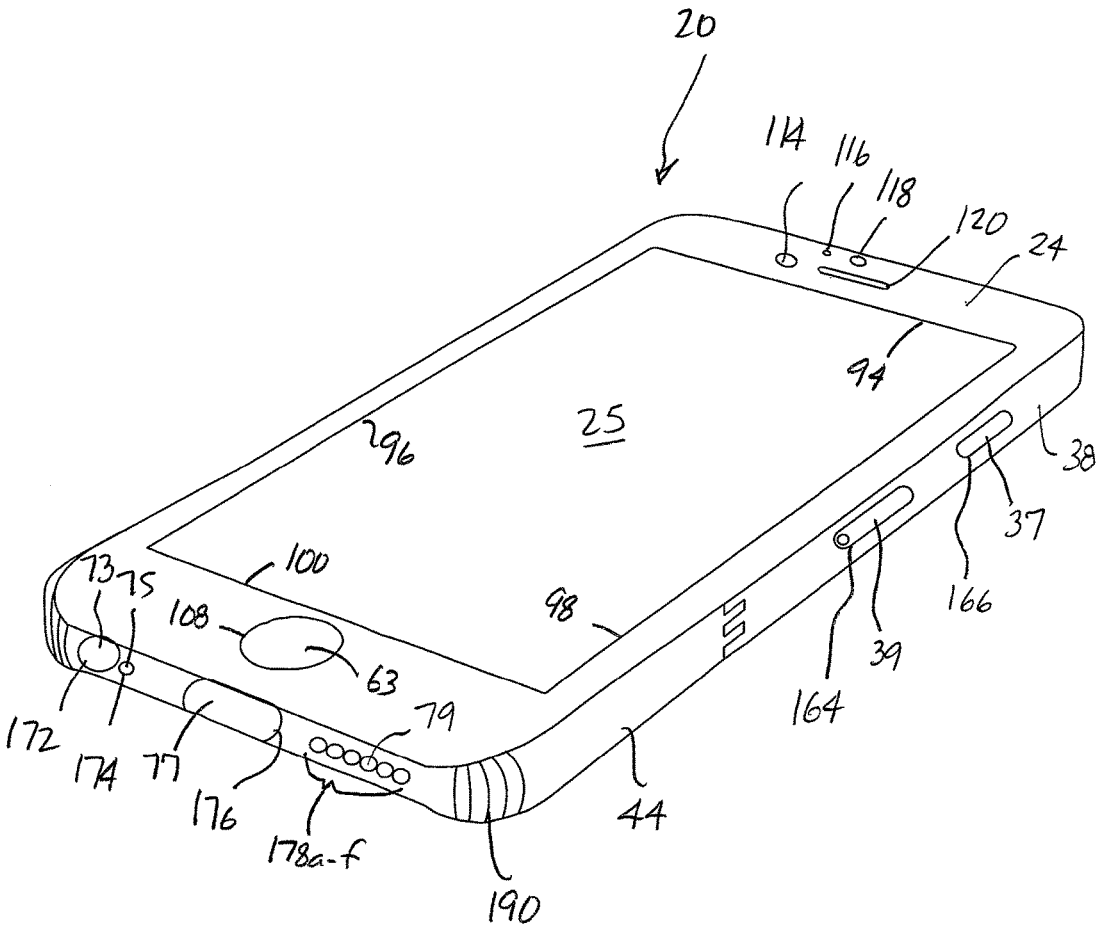
FIG. 9 is a perspective view of an exemplary mobile device encased in an exemplary embodiment of a folded protective covering constructed in accordance with the principles of the present invention.
Figure 14:
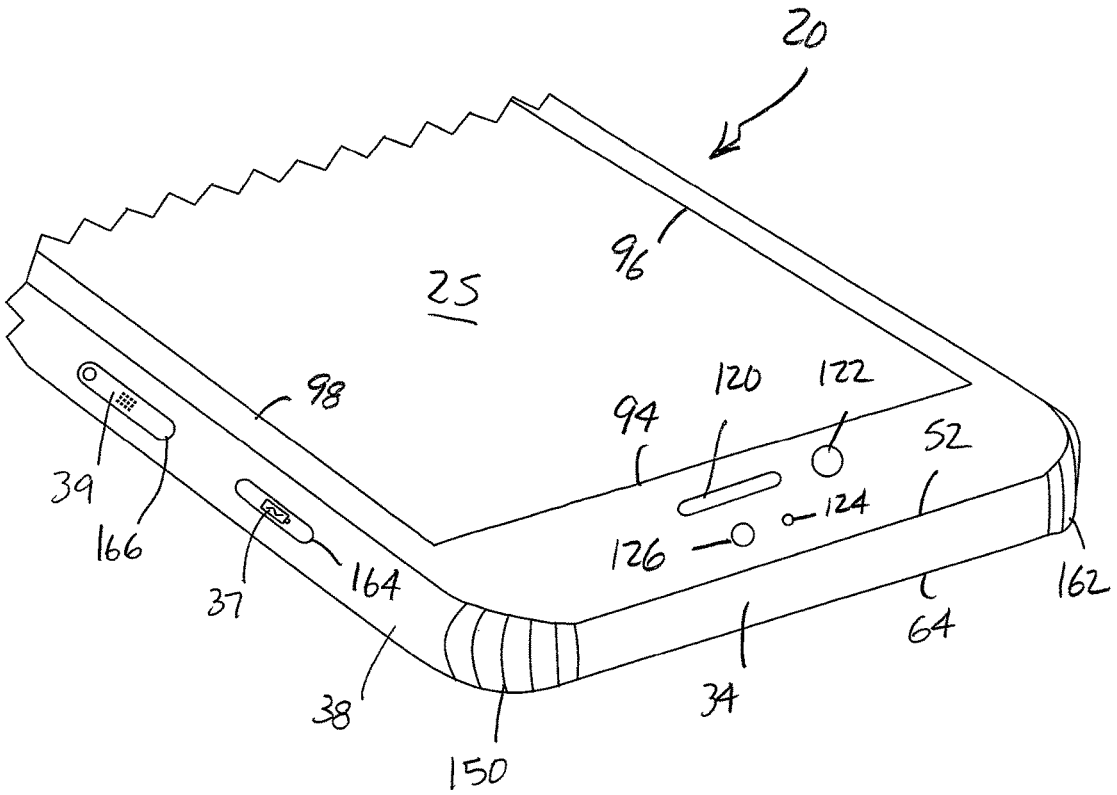
FIG. 14 is a partial perspective view of the top end of the encased mobile device of FIG. 9.

As illustrated in FIGS. 8 and 14, the user may then set the screen knockout 80 aside and place the remaining protective covering 20 with the interior surface 26 facing upwards as in FIG. 2. Next, the user may place the mobile device 22 face down onto the protective covering 20 and align the top edge 41 of the mobile device with the second fold line 64 and the bottom edge 43 of the mobile device with the third fold line 78 of the protective covering 20 as generally shown in FIG. 3. This positions the screen interface 25 of the mobile device 22 within the viewing window 92 (FIGS. 8-9 for example). The left edge 27 of the mobile device 22 should also be aligned, substantially aligned, or registered with the right outermost edge 70 of the central section 30 while the right edge 35 of the mobile device should also be aligned with the right outermost edge 72 of the central section 30 of the protective covering 20. This alignment is generally shown in FIG. 3.

Figure 4:
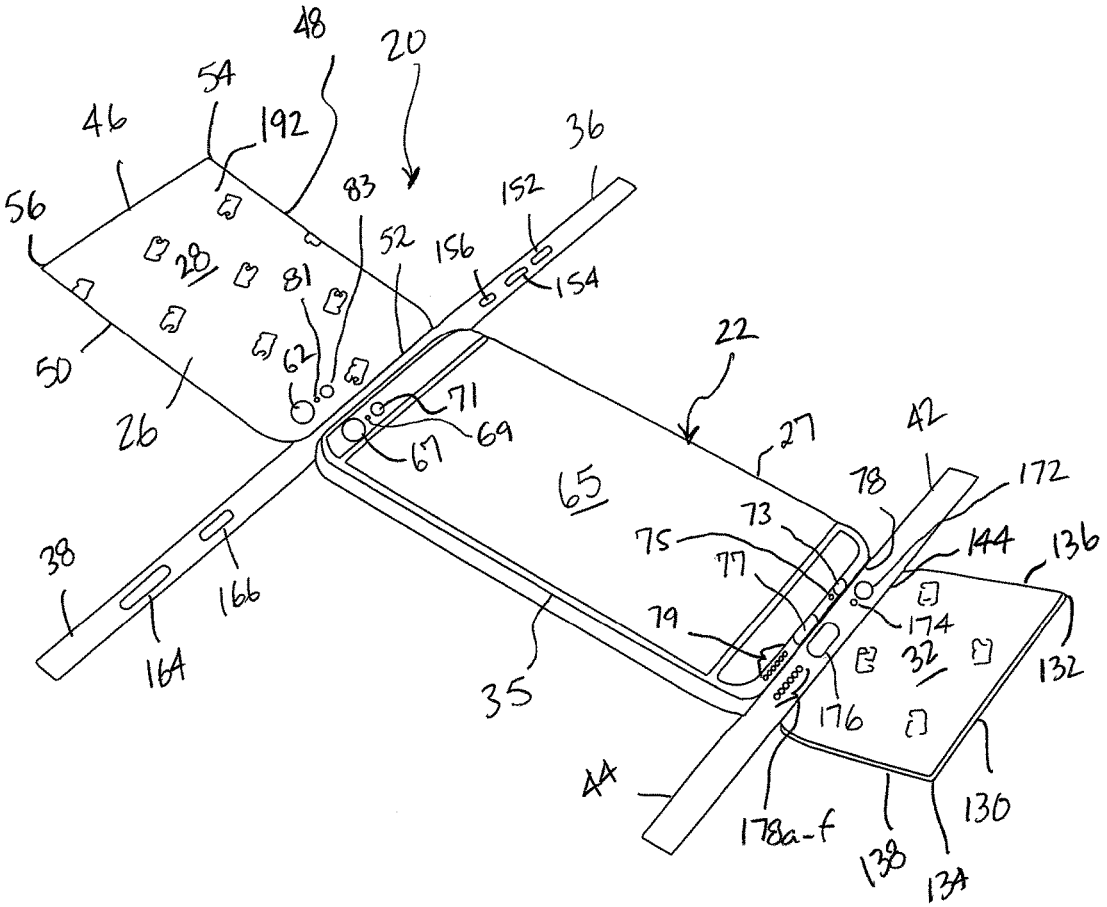
FIG. 4 is a similar view to FIG. 3 illustrating another exemplary step in the folding process showing the top and bottom sections partially folded.
Figure 5:
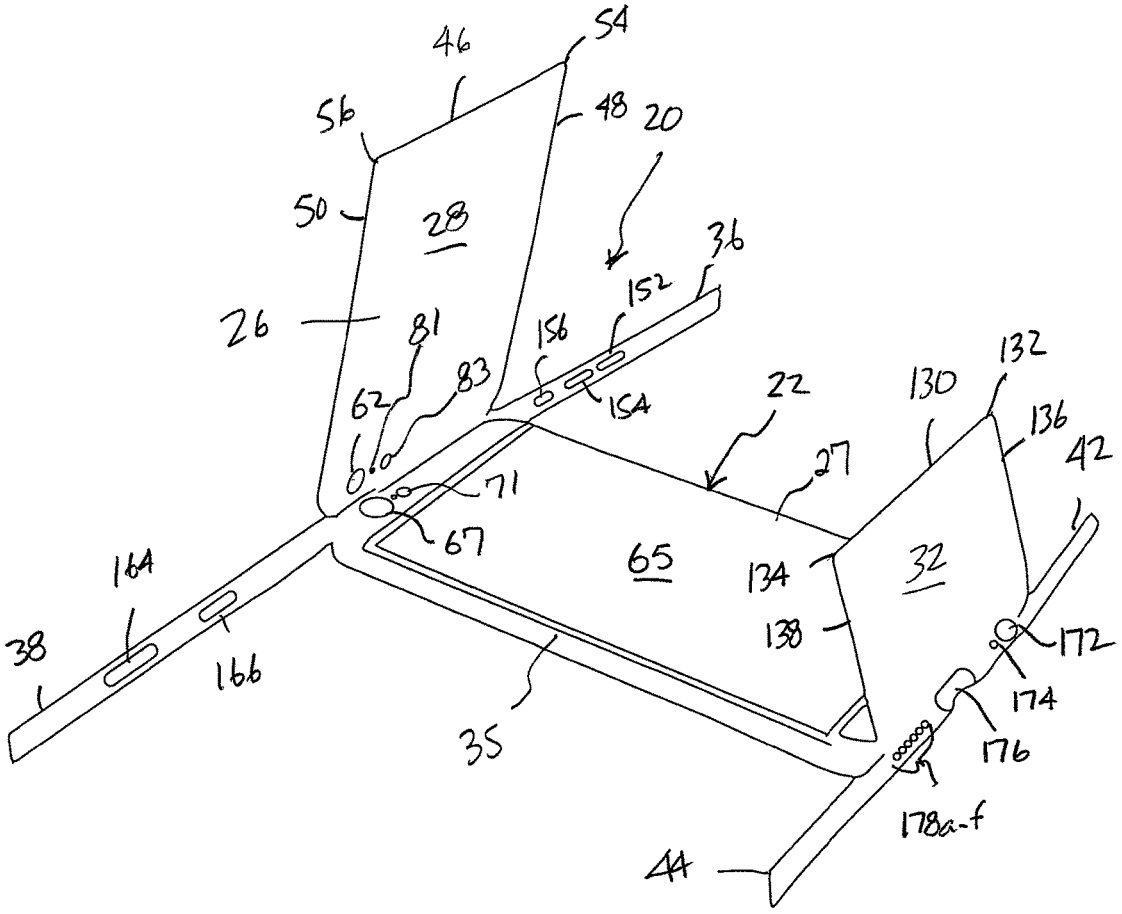
FIG. 5 is a similar view to FIG. 4 illustrating another exemplary step in the folding process showing the top and bottom sections folded further than in FIG. 4.

Referring now to FIGS. 3-5, the user may fold the top section 28 of the protective covering 20 first about the second fold line 64 until the interior surface of the top wall 34 abuts the outer surface of the top edge 41 of the mobile device 22. The user may then continue to fold the top section 28 about the first fold line 52 until the interior surface of the top section 28 lays flat against the rear surface 65 (FIG. 2) of the mobile device. In similar fashion, the user may fold the bottom section 32 about the third fold line 78 until the interior surface of the bottom wall 40 abuts the bottom edge 43 of the mobile device. The user may then continue the folding process by bending the bottom section 32 about the fourth fold line 144 until the interior surface of the bottom section 32 is flush against the rear surface 65 of the mobile device as well. The folding transition of the top and bottom sections 28, 32, respectively, is shown in FIGS. 4-5 with the final position of the top and bottom sections shown in FIG. 6.

Figure 6:
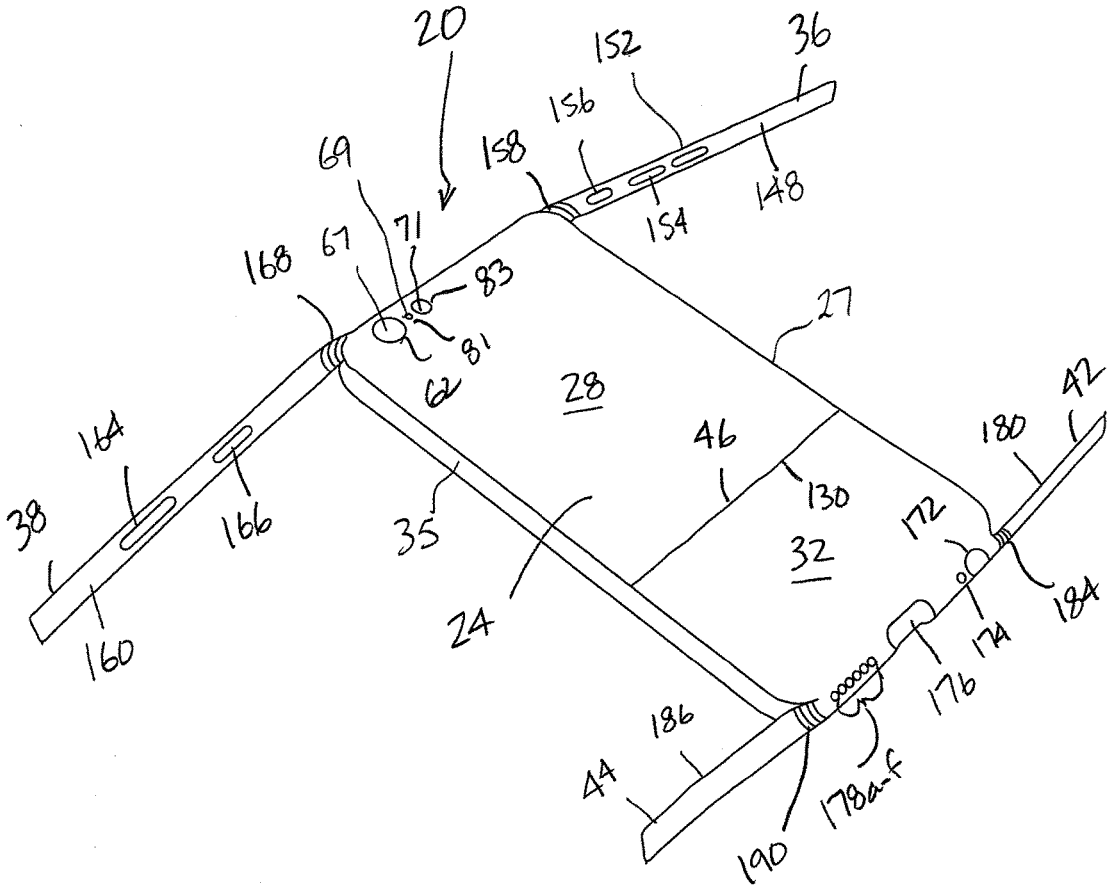
FIG. 6 is a rear view of the partially folded protective covering with the top and bottom sections folded over the mobile device and sidewalls still extended.

It will appreciated that, at the point in the folding process as shown in FIG. 6, the top and bottom sections 28, 32, respectively, either have their respective outermost edges 46, 130 spaced apart slightly, mated along a common edge, or overlap one another slightly. The top and bottom sections 28, 32, respectively, may be secured together or to the rear surface 65 of the mobile device 22 by using removing the backing 192 (FIG. 3) to expose an adhesive or tacky surface 194 of a double sided tape such as 3M 468 tape and then pressing the interior surfaces 26 of the top and bottom sections 28 and 32, respectively, against the rear surface 65 of the mobile device 22.

Figure 7:
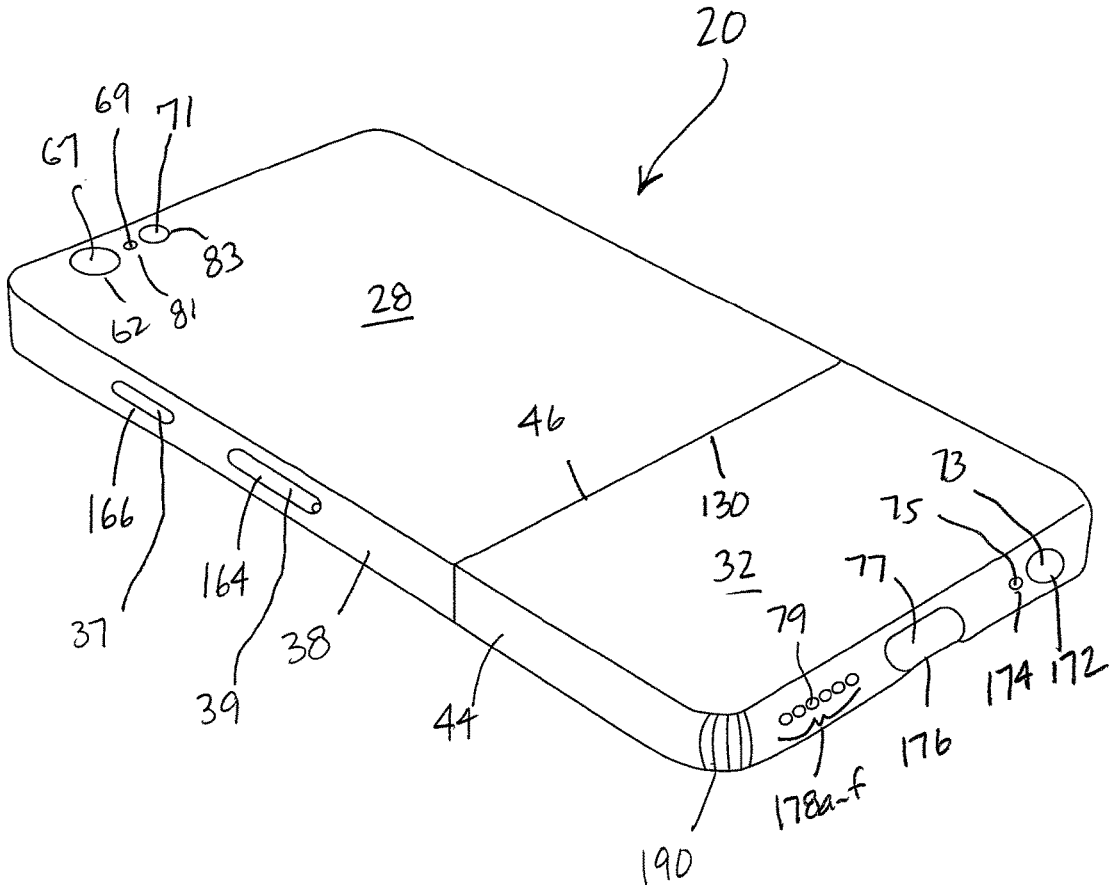
FIG. 7 is a similar view to FIG. 6, in enlarged scale, illustrating a fully folded protective covering with the side walls folded together.

Referring now to FIGS. 6-7, the upper left sidewall 36 may be bent by the user at the ribbed form section 150 toward the left side 27 of the mobile device. The bending process is facilitated by the ribs 158 (FIG. 2) introduced into the form section 150. Similarly, the lower left sidewall 42 may be bent upwardly toward the upper left sidewall 36 until the interior surface of the lower left sidewall abuts the left side of the mobile device as well. As with the top and bottom sections 28, 32, the upper left sidewall 36 and lower left sidewall 42 may be spaced apart slightly, mate along a common edge, or slightly overlap. The upper and lower left sidewalls, 36, 42 are retained in this configuration (FIG. 7) using a similar adhesive as with the top and bottom sections described above.

Still referring to FIGS. 6-7, on the opposing right hand side of the protective covering 20, the user may bend the outermost section 160 of the upper right sidewall 38 down toward the right edge 35 of the mobile device 22 with the ribs 162 facilitating the bending process until the interior surface of the upper right sidewall 38 is flush against the right edge 35 of the mobile device 22. Similarly, the lower right sidewall 44 may be bent upwardly toward the upper right sidewall 38 until the interior surface of the lower right sidewall abuts the right side of the mobile device as well. As with the top and bottom sections 28, 32, the upper right sidewall 38 and lower right sidewall 44 may be spaced apart slightly, mate along a common edge, or slightly overlap. The upper and lower left sidewalls, 38, 44 are retained in this configuration (FIG. 13) using and adhesive or tacky surface as described above.

At this point, the folded configuration of the protective covering 20 about the mobile device 22 resembles the configuration shown in FIGS. 7-14. More specifically, the viewing window 92 is aligned with the mobile device viewscreen 25 of the mobile device 22 on the front surface of the folded protective covering 20 as shown in FIGS. 7-11. The camera, microphone, flash, and speaker apertures created from removal of knockouts 114, 116, 118, 120 in the upper reduced section 112 of the central section 30 are aligned with the front camera 55, front microphone 57, front flash 59, and front speaker 61 of the mobile device 22 as shown in FIGS. 9, 10, 12, and 13.

Figure 10:
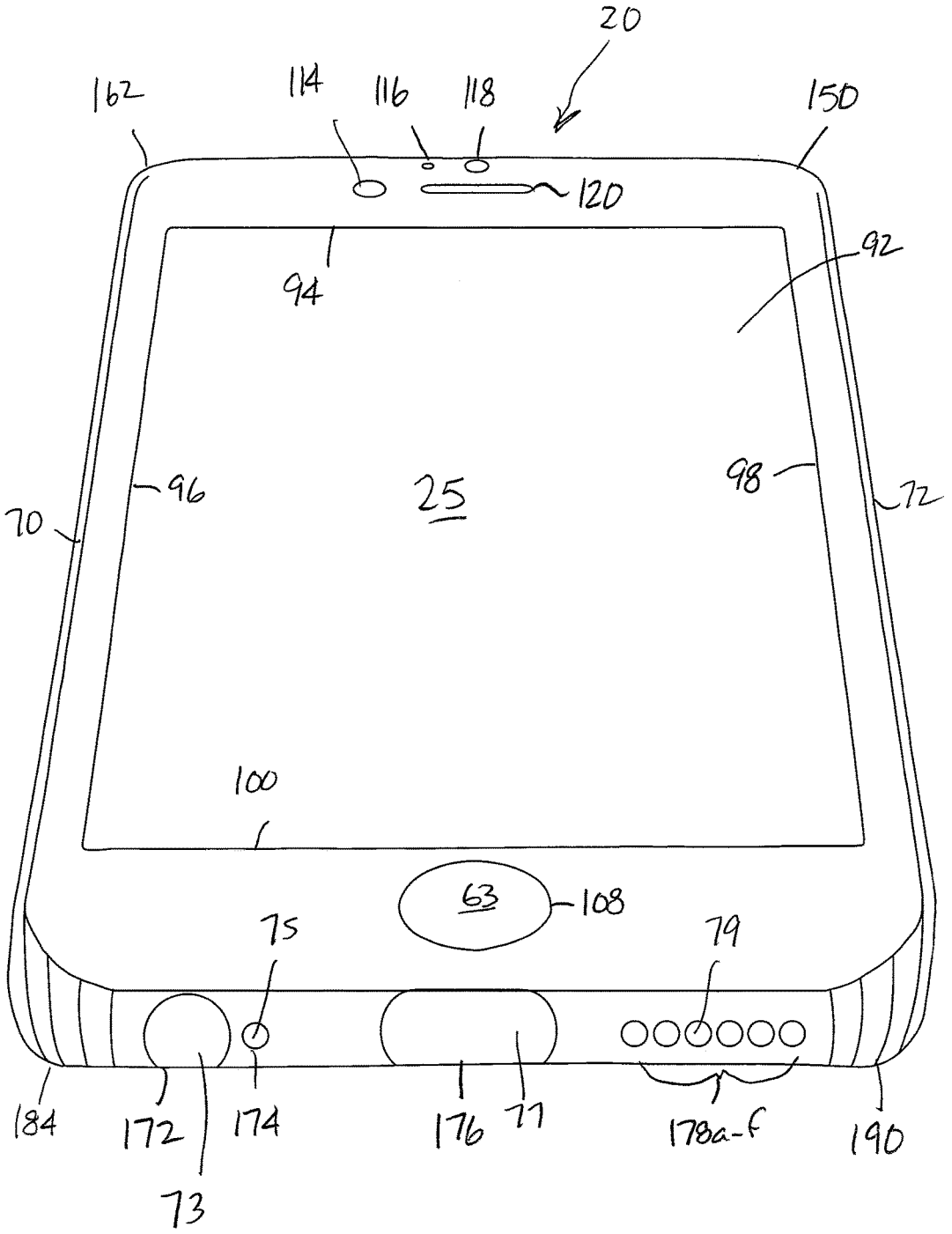
FIG. 10 is a front perspective view of the encased mobile device of FIG. 9.
Figure 11:
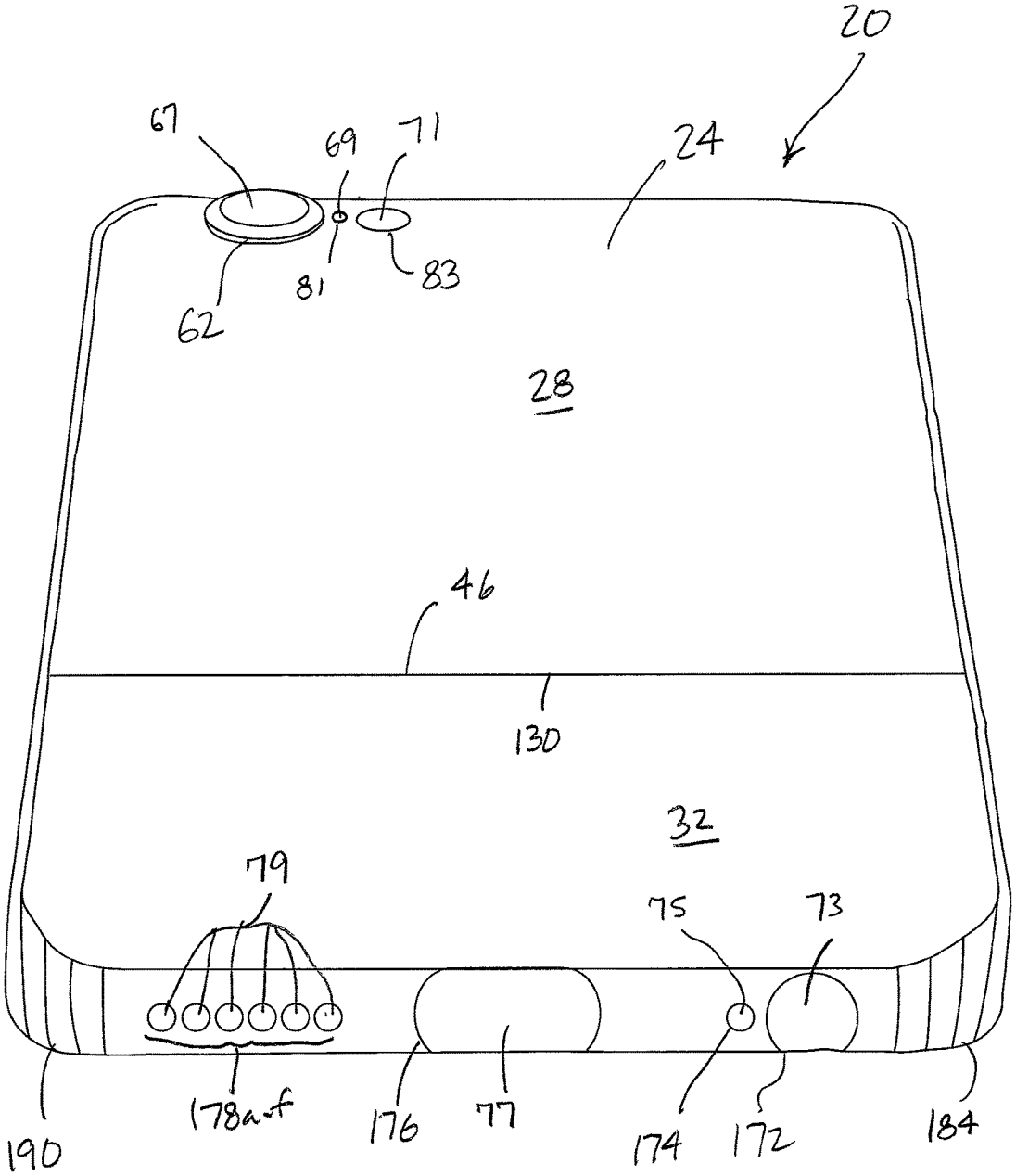
FIG. 11 is a rear perspective view of the encased mobile device of FIG. 9.

As viewed from the front as in FIGS. 9-10, the home button aperture 106 is also aligned to expose the home button 63 of the mobile device 22. As viewed from the left side of the folded protective covering 20 as in FIG. 12, the volume button apertures 152, 154 are aligned to expose the volume buttons 29, 31, respectively, of the mobile device 22 and the mute switch aperture 156 is aligned with the mute switch 33. As viewed from the right side of the folded protective covering 20 as in FIGS. 9 and 13, the on/off hold aperture 166 and SIM port slot 164 are aligned to expose the on/off button 37 and SIM port 39 button on the right side of the mobile device 22. As viewed from the top side of the folded protective covering 22 as in FIG. 14, there are no cutouts. Finally, as viewed from the bottom side of the folded protective covering 20 as shown in FIGS. 9-11, the audio jack port 172, microphone port 174, power supply/data transfer port 176, and bottom speaker ports 178*a-f* are all aligned with the counterparts 73, 75, 77, and 79, respectively, on the mobile device 22.

Figure 13:
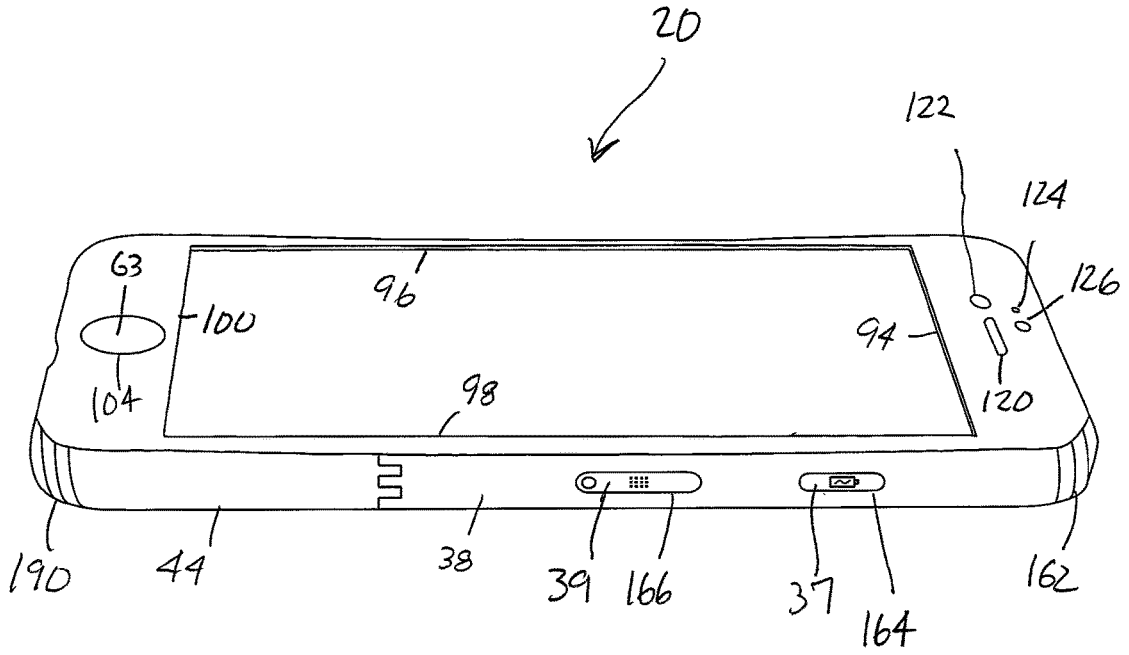
FIG. 13 is a right side perspective view of the encased mobile device of FIG. 9.

As discussed above, to maintain the protective covering 20 in a folded configuration around the mobile device 22, the interior surface 26 of the protective covering may be lined with adhesive or double sided stick tape, such as 3M 468. The liner 192 of the adhesive is then removed prior to the folding process leaving a tacky surface 194 for adhering the interior surface 26 of the protective covering 20 to the exterior surface 65 of the mobile device. Alternatively, the opposing folding sections (top and bottom, upper left wing and lower left wing, upper right wing and lower right wing) may overlap allowing for the tacky surface from the exposed adhesive on the interior surface of one section to adhere to the exterior surface of the opposing section. Interlocking means are also contemplated as shown in FIGS. 9, 12, and 13 illustrating interlocking "teeth". In addition, other adhesives, interlocking means, or fasteners such as clasps, hook and loop, buttons, snaps, hooks, magnets, and clips may be used as well. The protective covering may also be constructed of a material with a shape memory to maintain a folded configuration. Other suitable fastening and adhering means will occur to one of ordinary skill in the art.

Method of Manufacture of the Embodiments of the Present Invention.

In this exemplary embodiment, the protective covering 20 may be formed of a single piece of wood-like grass, such as bamboo. Bamboo is a fast growing grass and in plentiful supply and generally sustainable as well as flexible and strong enough to provide a suitable protective covering. In addition, bamboo has a distinct decorative surface and, as a natural material, may provide a unique appearance from covering to covering. In addition, materials may be selected from woods, plants, or grasses such as bamboo, teak, birch, wenge, zebrawood, mahogany, ebony, cedar, sapele, fir, walnut, and other suitable domestic or exotic woods capable of being cut into the desired shape and providing the requisite foldability. Other materials such as plastics, including vinyl, polyester, acetate, and metals may also be used. Other suitable materials capable of being cut and scored to provide designated fold lines, weakened score lines, and punch outs will occur to one of ordinary skill in the art.

In this exemplary embodiment, all sections and walls 28, 30, 32, 34, 40, 36, 38, 42, 44 are the same thickness (approximately 1/32 of an inch thick) and planar. However, this is not meant to be limiting in any manner.

Figure 15:
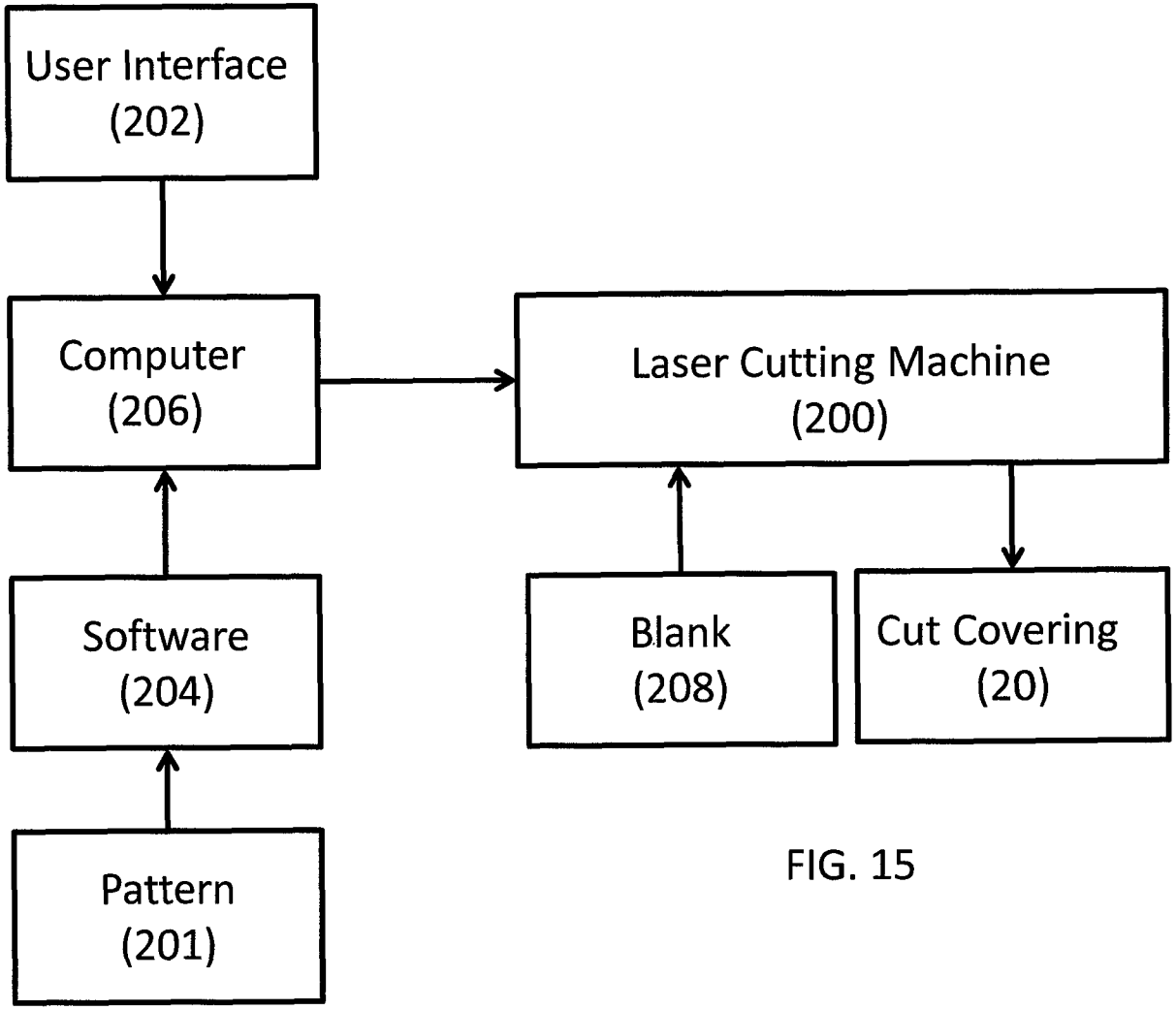
FIG. 15 is an exemplary schematic of a protective covering manufacturing system in accordance with the principles of the present invention.

Referring now to FIG. 15, the manufacture of the protective covering 20 will now be discussed. To form the protective covering, a laser engraving or cutting machine 200 may be programmed to laser etch the desired pattern 201 as shown in FIGS. 1-2 using a user interface 202 and software 204 loaded into a computer or processing device 206 in communication (by wired, wireless, or a combination of both technologies) with the laser cutting machine. The pattern 201 loaded into the computer is preferably based on dimensions of the OEM casing 23 of a selected electronic device 22 and the feature pattern or arrangement of the various components including, but not limited to, the views-creen, camera, microphone, flash, jacks, data ports, speakers, switches, slides, touch interfaces, and buttons appearing on the collection of the six faces of the selected electronic device 22 to ensure protective covering 20 will closely resemble the exterior dimensions of the OEM casing 23 to prevent the electronic device from sliding appreciably within the folded protective covering and the knockouts or apertures in the protective covering 20 align with the corresponding features on the electronic device when the protective covering is folded about the electronic device. Once the pattern 201 loaded into or otherwise made accessible to the laser cutting machine, a blank 208 may be placed in the machine. The machine is then activated and then program run to control the pattern created on the blank by the machine. Once the program has run and the pattern, such as that shown in FIG. 1 is complete, the user may retrieve the cut protective covering 20. Either a single covering may be cut from a single blank, or multiple coverings from a single blank, or multiple stacked blanks may be cut, or single or multiple blanks cuts at multiple stations. It is also feasible that a protective covering may be cut from a blank manually but this does not facilitate mass production and may be deemed quite tedious. A suitable laser cutting machine has been found to be Epilog Mini 18 35 Watt Laser cutter.

A programmable CNC machine may also be used. Instead of laser cutting, the blank 208 may also be die cut into the foldable protective covering.

It will be appreciated that the laser cutting machine may be programmed to cut or engrave to a particular depth thereby leaving a score line, weakened area, or complete pass-through on the blank to facilitate a fold line or removal line or simply provide a cutout. It will be appreciated that all intact knockouts or punch-outs include peripheral weakened regions or score lines to facilitate their removal in use. Alternatively, the apertures may be pre-cut during the manufacturing process to save the user time from removing the knockouts, although leaving the knockouts intact during shipping does add strength to the overall protective covering 20. It will also be appreciated that alternative knockout positions may be cut into the protective coverings 20 during manufacture to accommodate different mobile devices 22 and the overall pattern 201 may be varied by altering the programming of the computer.

Herein, the term encase means to at least partially surround the mobile device 22 with the protective covering 20 in a folded configuration with the protective covering including one or more openings for accessing the functionality of the mobile device.

Herein, the terms laser cut, cut, engrave, etch, burn, imprint, weaken, and score are all interchangeable and generally mean to impart a straight or curved line onto a substrate such as the bamboo blank described herein. The lines may be of the same or variable depth and may be decorative on the surface only, penetrate the surface for decoration or weakening, or project all the way through the blank for a complete cutout.

Variations of the Embodiments of the Present Invention:

In addition to the horizontal parallel fold lines discussed herein, other fold line orientations and locations may be used including folding left and right halves together with vertical fold lines, angled fold lines, folding an entire section to meet an edge, and sections of varying sizes may also meet the principles of the present invention. In addition, other means of securing the covering to either the mobile device or to other sections of the protective covering may be used. The pattern 201 may also be varied to accommodate other mobile device shapes and provide other knockout locations and shapes to accommodate other mobile devices.

Another protective covering 20 alternative is the use of the screen knockout piece 80 as a storage holder for one or more of the protective covering knockouts 81, 83, 102, 114, 116, 118, 120, 152, 154, 156, 164, 166, 172, 174, 176, and 178*a-f*. For example, for some electronic devices 22, the device buttons, for example, the up/down volume buttons 29, 31, may extend outside the protective covering and are easily accessible and selected or depressed without difficulty. The thin profile of the protective covering 20 facilitates access to these buttons in most instances. However, in other electronic devices 22, the device buttons are either flush with or recessed from the outer surface 24 of the protective covering 20. In those instances, the user may have more difficulty depressing the device buttons. One solution is to use enlarged knockout sections that provide easier access to the flush or recessed device buttons. Another solution is to remove the corresponding knockouts as for example, the up and down volume button knockouts 152, 154, respectively, and store them in corresponding slots (openings or apertures) in the screen knockout piece such as in slots 210, 212, respectively, as shown in FIGS. 1 and 8 until needed. In this example, the screen knockout piece 80 is constructed with a number of knockouts or cutouts (such as 210, 212 in FIGS. 1 and 8) corresponding to one or more of the protective covering knockouts 81, 83, 102, 114, 116, 118, 120, 152, 154, 156, 164, 166, 172, 174, 176, and 178*a-f*. These screen knockout pieces may be removed from the screen knockout piece 80 to provide a storage slot for one or more of the protective covering 20 knockout pieces 81, 83, 102, 114, 116, 118, 120, 152, 154, 156, 164, 166, 172, 174, 176, and 178*a-f*. Each of the protective covering knockout pieces 81, 83, 102, 114, 116, 118, 120, 152, 154, 156, 164, 166, 172, 174, 176, and 178*a-f* also includes an adhesive material and liner that may be peeled off to expose a tacky surface for adhering the button knockout piece 152, 154 to the corresponding mobile device button 29, 31, respectively, while maintaining the thin profile of the protective covering 20. This knockout piece placement over the device buttons also assists the user in depressing the flush or recessed device buttons. It will be appreciated that some knockout pieces do not require storage in the screen knockout piece 80 since there is no corresponding button such as the microphones or SIM card slot. Other reasons for adding on the protective covering knockouts is for transport and protection such as when protecting the mobile device camera lens. Alternatively, instead of or in addition to providing storage of the knockout pieces 81, 83, 102, 114, 116, 118, 120, 152, 154, 156, 164, 166, 172, 174, 176, and 178*a-f*, the screen knockout piece 80 may also provide the full set of replacement knockout pieces 81, 83, 102, 114, 116, 118, 120, 152, 154, 156, 164, 166, 172, 174, 176, and 178*a-f* that may be removed and adhered to the desired buttons to improve the accessibility of the mobile device buttons. It will be appreciated that the viewing windows, knockouts, and cutouts described may be located within one or more sections of the protective covering 20. For example, the viewing window 92 may be defined by two panels or sections folded together. As another example, the other knockouts or cutouts may appear partially in one section and wrap around into an adjacent section.

While the foregoing examples are generally discussed in terms of protective coverings for use with a conventional iPhone 5, 5S, 6, or 6S, it will be appreciated that the protective coverings may be constructed to be used with a variety of electronic devices, including the iPhone 7 varieties, as well other brand name smartphones, and smart watches, cellular phones, tablets, laptops, and other portable electronic devices, including, but not limited to those provided by Samsung, Blackberry, LG, Google, Sony, ASUS, Motorola, Nokia, Alcatel, Lenovo, Huawei, and HTC. Once the electronic device is selected and the external feature pattern is known, the computer may be programmed with a matching or mimicking pattern to cut the blank.

The spirit of the present invention provides a breadth of scope that includes all methods of making and using. Any variation on the theme and methodology of accomplishing the same that are not described herein would be considered under the scope of the present invention. For example, the numbers for widths, thicknesses, lengths, recess depths, and other dimensional characteristics used herein are meant to be illustrative and not limiting.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

In general terms, the foldable protective covering constructed in accordance with the principles of the present invention comprises a blank laser cut into a central section, a top section, a bottom section, and left and right upper and lower sidewall sections separated by fold lines with at least one section include a knockout section constructed for removal and alignment with a functional feature of the mobile device and at least one screen opening for alignment with a user interface of the mobile device wherein the unitary protective covering may be folded to surround, encase, and protect the mobile device while providing access to the functional features and user interfaces of the mobile device.

In the addition, the protective covering constructed in accordance with the principles of the present invention may be constructed using a laser engraving machine or die cutting machine to cut, etch, burn, carve or engrave a blank into a central section with a user interface knockout, a top section, a bottom section, and opposing sidewalls sections with at least one section having a knockout region which may be removed and the protective covering sections folded about the mobile device with the knockout region aligned with one or more functional regions of the mobile device and the interface knockout exposing at least a portion of the user interface of the mobile device to at least partially surround, encase, and protect the mobile device, all from the unitary protective covering cut from a blank placed into a programmable laser cutting machine. A method of wrapping the consumer electronic device is also disclosed herein.

What is claimed is:

1. A protective covering for an electronic device with a case defining a viewscreen and a pre-determined feature pattern with at least one feature, the protective covering comprising:

a protective covering body having a first section and at least one adjacent folding section hingedly coupled to the first section, at least one of the sections defining a viewing window and at least one of the sections defining at least one aperture, the protective covering body being constructed to fold about the case of the electronic device to align the viewing window with the viewscreen and align the at least one aperture with the at least one feature to provide access thereto;

at least one feature knockout in the adjacent folding section provides the at least one aperture when removed from the protective covering body; and a viewscreen knockout providing the viewing window when removed from the protective covering body, the viewscreen knockout including at least one aperture constructed to releasably retain at least one complementary knockout of another feature knockout for storage.

2. The protective covering as set forth in claim 1 wherein:

the protective covering body is formed from a blank of a unitary material based on a programmed pattern substantially mimicking the location of the viewscreen and the pre-determined feature pattern of the electronic device.

3. The protective covering as set forth in claim 2 wherein:

the unitary material is selected from the group consisting of a wood, grass, and plant-based material.

4. The protective covering as set forth in claim 2 wherein:

the unitary material is selected from the group consisting of bamboo, teak, birch, wenge, zebrawood, mahogany, ebony, cedar, sapele, fir, and walnut.

5. The protective covering as set forth in claim 1 wherein:

the first section defines a central section of the protective covering body;

a first adjacent section is hingedly coupled to a first portion of the central section; and a second adjacent section is hingedly coupled to an opposing portion of the central section.

6. The protective covering as set forth in claim 5 further including:

a first wall disposed between the first adjacent section and the central section;

at least one folding joint between the first adjacent section and the central section;

a pair of upper sidewalls extending outwardly from the first wall;

a second wall disposed between the second adjacent section and the central section;

at least one separate folding joint between the second adjacent section and the central section;

a pair of complementary lower sidewalls extending outwardly from the second wall, the sidewalls being constructed to fold toward one another and be releasably retained together to cover a pair of opposing faces of the electronic device when folded thereabout; and at least feature knockout in at least one of the walls or sections defining the at least one aperture when removed from the protective covering body.

7. The protective covering as set forth in claim 1 wherein:

the protective covering body is formed by a cutting machine programmed with a pattern based on the configuration of the electronic device including the location of the viewing screen and arrangement of the pre-determined feature pattern.

8. The protective covering as set forth in claim 1 wherein:

the first section and the adjacent section are constructed to be fastened to the exterior of the case of the electronic device to retain the sections in a folded configuration.

9. The protective covering as set forth in claim 1 wherein:

the first section and the adjacent section are constructed to be fastened to one another to retain the sections in a folded configuration.

10. The protective covering as set forth in claim 1 wherein:

the protective covering body at least partially exposes the viewscreen through the viewing window when the adjacent folding section is folded relative to the first section and placed parallel thereto.

11. The protective covering as set forth in claim 1 wherein:

the protective covering body is a unitary piece of material laser cut with a pre-programmed pattern based on the dimensions, the viewscreen location, and the pre-determined feature pattern of the electronic device.

12. The protective covering as set forth in claim 1 further including:

at least one fold line in the protective covering body between adjacent sections;

at least one weakened score line in the protective covering body providing at least one feature knockout defining the at least one aperture when removed from the protective covering body with the fold line and the weakened score line introduced into the protective covering body by a laser cutting machine.

13. The protective covering as set forth in claim 1 further including:

a third section foldably coupled to the first section;

a volume button knockout in at least one of the sections defining a volume button aperture when removed from the protective covering body;

a power button knockout in at least one of the sections defining a power button aperture when removed protective covering body;

a camera knockout in at least one of the sections defining a camera aperture when removed from the protective covering body; and wherein the knockouts are constructed to be removed prior to folding the first, second, and third sections about the electronic device to align the volume button aperture with a volume button of the electronic device, align the power button aperture with a power button of the electronic device, and align the camera aperture with a camera of the electronic device.

14. The protective covering as set forth in claim 1 wherein:

the innermost and outermost surfaces of the protective covering body, when folded about the electronic device, are constructed from the same single layer of bamboo.

15. The protective covering as set forth in claim 1 wherein:

the innermost surface of the protective covering body, when folded about the electronic device, directly abuts the majority of the outer surface of the electronic device.

16. A protective covering for an electronic device with a case defining a viewscreen and a pre-determined feature pattern with at least one feature, the protective covering comprising:

a protective covering body formed by cutting a planar blank from a unitary piece of material with a machine loaded with a programmed pattern, the programmed pattern including:

a central section including a viewing screen window;

a top wall joined to the uppermost edge of the central section by a first fold line, the top wall including a first upper sidewall extension and an opposing second upper sidewall extension;

a top section joined to the uppermost edge of the top wall by a second fold line;

a bottom wall joined to the lowermost edge of the central section by a third fold line, the bottom wall including a first lower sidewall extension and an opposing second lower sidewall extension;

a bottom section joined to the lowermost edge of the bottom wall by a fourth fold line; and at least one feature knockout portion in at least one of the walls or sections constructed to provide at least one feature aperture when removed;

the protective covering body is constructed to substantially envelope and protect the case of the electronic device when folded at the fold lines to align the viewing screen window with the viewscreen and align the at least one feature aperture with the at least one feature; and at least one feature knockout portion includes at least one storage knockout region constructed to releasably retain at least one other feature knockout portion therein.

17. The protective covering as set forth in claim 16 wherein:

the first upper sidewall and first lower sidewall are releasably coupled together to protect a first face of the case of the electronic device; and the second upper sidewall and second lower sidewall are releasably coupled together to protect an opposing face of the case of the electronic device.

* * * * *